United States Patent [19]

Okonowski

[11] 4,173,337

[45] Nov. 6, 1979

[54] BASEBALL BATTING AND PITCHING APPARATUS

[76] Inventor: Richard L. Okonowski, 32232 Eastway, Roseville, Mich. 48066

[21] Appl. No.: 853,324

[22] Filed: Nov. 21, 1977

[51] Int. Cl.[2] ..... A63B 69/40

[52] U.S. Cl. ..... 273/26 A; 273/127 B; 273/26

[58] Field of Search ..... 273/26 A, 25, 102, 176, 273/181, 127 R, 127 B, 127 D, 29 A, 26 R

[56] References Cited

U.S. PATENT DOCUMENTS

| | | | |
|---|---|---|---|
| 1,170,715 | 2/1916 | Westgate | 273/26 A |
| 1,592,005 | 7/1926 | Rovane | 273/29 A |
| 1,652,062 | 12/1927 | Stauffer | 273/102 R |
| 2,040,228 | 5/1936 | Whiteley | 273/26 A |
| 2,087,575 | 7/1937 | Littell et al. | 273/29 A |
| 2,162,438 | 6/1939 | Letaret | 273/26 A |
| 2,254,986 | 9/1941 | Ziel | 273/26 A |
| 2,873,969 | 2/1959 | Ziel | 273/26 A |
| 2,978,246 | 4/1961 | Van Groniger | 273/26 A |
| 3,001,790 | 9/1961 | Pratt | 273/26 A |
| 3,312,467 | 4/1967 | Dawson | 273/26 A |
| 3,583,703 | 6/1971 | Brown | 273/26 A |
| 3,658,329 | 4/1972 | Ciccarello | 273/26 A |
| 3,940,131 | 2/1976 | Claire, Jr. | 273/29 A |
| 3,979,116 | 9/1976 | Matchick | 273/26 R |
| 3,997,158 | 12/1976 | Britton | 273/26 A |

*Primary Examiner*—Richard C. Pinkham
*Assistant Examiner*—T. Brown
*Attorney, Agent, or Firm*—Robert G. Mentag

[57] ABSTRACT

A baseball practice device which can be used for batting and pitching practice. An elongated support plate has mounted thereon a baseball home plate and a batter's box area marked thereon in a position adjacent the baseball home plate. A first support means is mounted adjacent the baseball home plate on the support plate. A pad means is carried by the first support means and arranged to form a strike zone area over the baseball home plate. The strike zone area is enclosed on three sides and open at one side to allow baseballs to be thrown into the strike zone area for baseball practice. A second support means is mounted on the suppport plate, and carries a batter image pad means over the batter's box area for pitching practice. A strike zone pad means may be mounted in the strike zone area and provided with numbered zones.

8 Claims, 4 Drawing Figures

BASEBALL BATTING AND PITCHING APPARATUS

BACKGROUND OF THE INVENTION

1. Field of the Invention

This invention relates to baseball practice devices, and more particularly, to a practical device for use by baseball pitchers and batters to define a strike zone, at which the pitcher may practice throwing baseballs, and batters may be served pitches, for pitching and batting practice.

2. Description of the Prior Art

It is known in this art to employ various baseball pitchers' practice devices and batters' practice devices. Heretofore, baseball pitchers' practice devices have been provided in the form of a tubular frame structure with pads to define a strike zone, and an example of this type practice device is illustrated in U.S. Pat. No. 3,312,467, and in 3,583,703. Pitching practice devices of the type defining a strike zone by a swingable gate are illustrated in U.S. Pat. No. 3,658,329. Illustrations of prior art pitching practice and batting practice devices are illustrated in U.S. Pat. Nos. 1,592,005, 1,652,062, 2,040,228, 2,162,438, 2,254,986, 2,873,968, 2,978,246, 3,001,790 and 3,633,090.

SUMMARY OF THE INVENTION

The present invention relates to the baseball practice art, and more particularly to a unique baseball practice device which can be used for batting or pitching practice, either individually or combined.

The baseball practice device of the present invention includes an elongated support plate which has mounted thereon a baseball home plate. A batter's box area is marked on the support plate in a position adjacent the baseball home plate. A first support means comprising an L-shaped tubular structure is mounted adjacent the baseball home plate on the support plate. A pad means comprising a plurality of pads is carried by the first support means, and they are arranged to form a strike zone area over the baseball home plate. The strike zone area is enclosed on three sides and open on one side thereof adjacent the batter's box area to allow a baseball to be thrown into the strike zone area for baseball practice. The strike zone area can be used for either pitching or batting practice. A second support means in the form of a tubular L-shaped structure is adapted to be mounted on the support plate and carry a batter image pad means over the batter's box area for pitching practice. The batter image pad enables a pitcher using the practice device to visualize a replica of a batter, and to provide a realistic gamelike situation for the pitcher. A strike zone pad means may be mounted in the strike zone area and provided with numbered zones to enable a pitcher using the practice device to determine just where his pitches are entering the strike zone.

The baseball practice device of the present invention may be made in any desired size so that it may be made for little league use or big league use.

While it will be apparent that the preferred embodiments of the invention herein disclosed are well calculated to fulfill the objects above stated, it will be appreciated that the invention is susceptible to modification, variation and change.

DETAILED DESCRIPTION OF THE PREFERRED EMBODIMENTS

Figure 1:
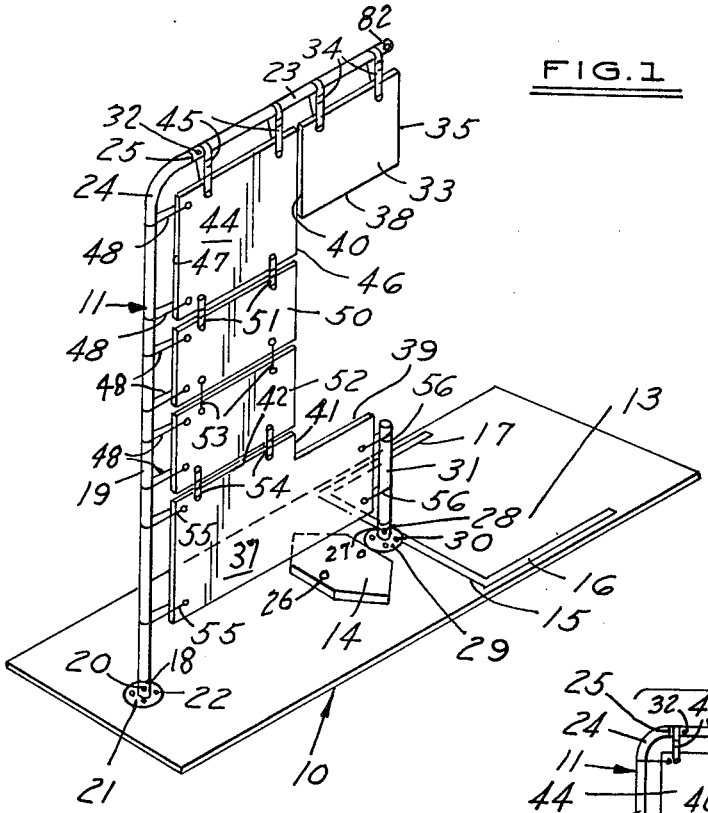
FIG. 1 is an elevational perspective view of the baseball practice device of the present invention in assembled condition for use in practicing batting.

As shown in FIG. 1, the baseball practice apparatus of the present invention includes an elongated support base plate, generally indicated by the numeral 10. The support base plate 10 is made from any suitable material, as for example, metal, wood, plastic, and the like. The numeral 11 generally designates the batting practice support assembly. The numeral 12 generally designates in FIGS. 2 and 3 the attachment structure for holding the pitching practice added structure, which is shown in detail in FIG. 3.

Figure 2:
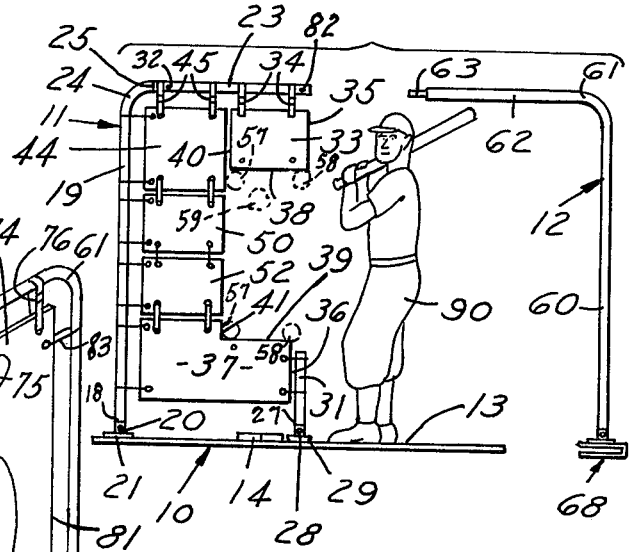
FIG. 2 is a front elevation view of the baseball practice device shown in FIG. 1, and showing the pitching practicing structure detached from the batting practice structure.
Figure 3:
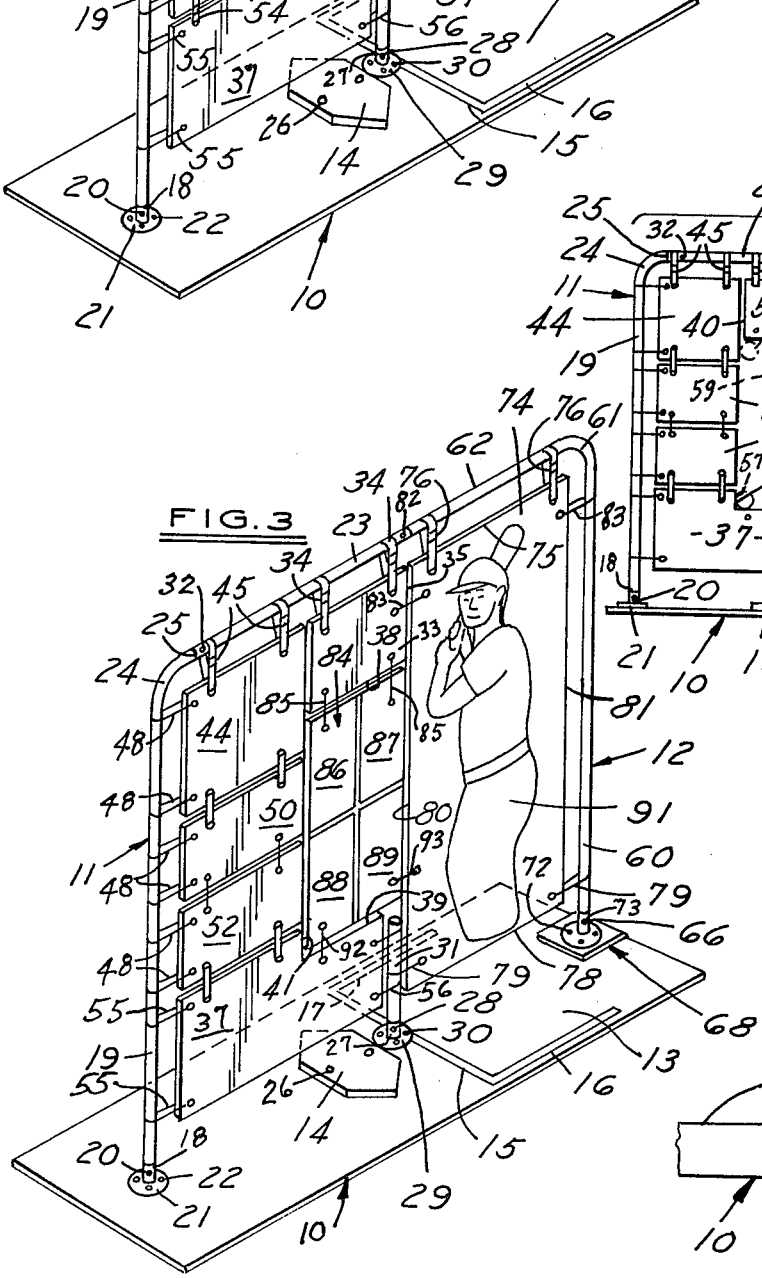
FIG. 3 is an elevational perspective view of the baseball practice device assembled in condition for pitching practice.

As best seen in FIGS. 1 and 3, the numeral 13 designates the batter's box area for a right handed batter. The invention is illustrated in FIGS. 1, 2 and 3 as being set up for a right handed batter for batting practice, and for pitching to a right handed batter for pitching practice. However, it will be understood that the baseball practice apparatus of the present invention can be turned around for a left handed batter, for either left-handed batting practice or pitching practice. The top surface of the support base plate 10 may be made with any desired color. The top surface of the support base plate 10, for example, may be painted black The batter's box area 13 may be defined by taped or painted lines 15, 16 and 17, and wherein said lines are made to a color different from the support base plate color, as for example, white. The outer ends of the longitudinal lines 16 and 17 designate the rear end of the batter's box area 13, and the front line 15 designates the inner side of the batter's box area 13.

A suitable baseball home base plate 14 is mounted on the support base plate 10 and positioned adjacent the batter's box area 13, in accordance with the usual spacing of the home base plate from the batter's box area. The base plate 14 may be made from the same material as the base plate 10, and it is secured on the top surface of the base plate 10 by any suitable means, as for example, by a suitable adhesive, or by suitable screws 26.

Figure 4:
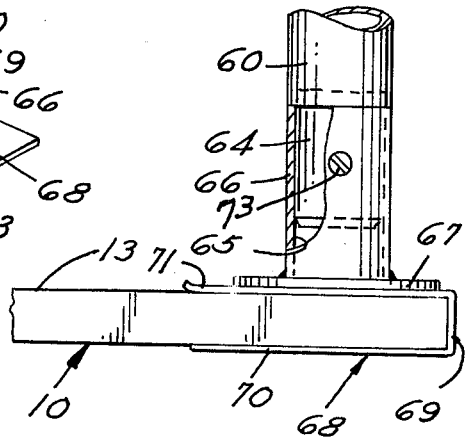
FIG. 4 is a fragmentary, enlarged view of the attachment structure for the pitching practice added structure.

The batting practice support structure includes a vertical pipe or post 19 which has its lower end provided with a reduced diameter extension, similar to that shown in FIG. 4, which is slidably mounted in the upper end of a short mounting pipe 18, and it is fixed as by welding to a circular mounting flange 21. The flange 21 is secured as by suitable screws 22 to the base plate 10. The pipe 19 is secured by any suitable means to the pipe 18, as by screws 20. The batting practice support structure further includes an upper horizontal pipe 23, which has one end attached at the joint line 25 to the horizontal end of an L-shaped pipe 24. The vertical end of the L-shaped pipe 24 is integrally formed with the upper end of the pipe 19. The pipe 23 is provided with a reduced diameter extension, similar to that shown in FIG. 4, which is slidably mounted in the horizontal end of the L-shaped pipe 24 and secured thereto by a suitable screw 32.

A second vertical pipe 31 has its lower end supported in a mounting pipe 28, which has its lower end fixed, as by welding to a circular mounting flange 29 which is secured to the base plate 10 by any suitable means, as by a plurality of suitable screws 30. The lower end of the pipe 31 is also provided with a reduced diameter end, similar to that shown in FIG. 4, which is slidably mounted in the upper end of the pipe 27 and secured thereto by a screw 28.

As shown in FIGs. 1 and 2, a plurality of pads made from a suitable resilient material, such as rubber or the like, is secured to the horizontal pipe 23 and the vertical pipe 19, and they are disposed so as to form an opening along one side of the pads which is equal to the height of the strike zone, but which is wider than the strike zone by approximately the width of a baseball. A rectangular pad 33 is disposed over the base 14, and it is adjustably retained on the horizontal pipe 23 by a pair of suitable adjustable straps 34. The straps 34 extend over the pipe 23 and through suitable holes formed along the upper end of the pad 33. The adjustable straps 34 are adjustable so that the pad 33 may be adjusted upwardly or downwardly, as desired, so as to position the lower edge 38 of the pad at the shoulder height of a batter, as indicated by the numeral 90 in FIG. 2. The lower horizontal edge of the pad 33 thus forms the upper end of the strike zone for the particular batter 90 to which the pad is adjusted in accordance with his height. The inner side of the pad 33 is indicated by the numeral 35 and it is positioned so that it is parallel with a vertical line which would be laterally off-set from the strike zone by approximately the width of a baseball. The outer edge of the pad 33 is designated by the numeral 40.

A lower pad 37, which is substantially L-shaped, is mounted between the vertical pipe 31 and the lower end of the vertical pipe 19. The inner side 36 (FIG. 2) of the pad 37 is disposed adjacent the vertical pipe 31, and it is disposed along a vertical line. The upper side of the pad 37 is stepped, with an inner horizontal portion 39 that terminates at its outer end in a vertical edge 41 which terminates at its upper end in a horizontal outer edge 42. The pad 37 is attached to the vertical pipe 31, along its inner edge 36, by a pair of adjustable straps 56. The outer edge of the pad 37 is vertically disposed and spaced from the vertical pipe 19, and it is adjustably secured thereto by a pair of suitable adjustable straps 55.

A rectangular pad 44 is mounted adjacent the outer edge 40 of the pad 33, and it is suspended from the horizontal pipe 23 by a pair of suitable adjustable straps 45. As shown in FIG. 1, the vertical inner side edge 46 of the pad 44 is slightly spaced apart from the pad 33 when in use. The outer vertical edge 47 of the pad 44 is spaced apart from the vertical pipe 19, and it is adjustably secured thereto by suitable adjustment straps 48 (FIG. 1). A rectangular pad 50 is hung beneath the pad 44 by a pair of suitable adjustable straps 51 (FIG. 1). The outer vertical side edge of the pad 50 is adjustably secured by a pair of suitable adjustable straps 48 to the vertical pipe 19. A rectangular pad 52 is hung below the rectangular pad 50. The pad 52 is suspended from the lower edge of the pad 50 by a pair of suitable adjustable straps 53. The outer side edge of the pad 52 is adjustably secured to the vertical pipe 19 by a pair of suitable adjustable straps 48. The lower edge of the pad 52 is attached to the upper edge 42 of the pad 37 by a pair of suitable adjustable straps 54.

The pad 33 is preferably disposed with its inner edge 35 (FIG. 2) in alignment with the inner side of the short vertical pipe 31, and with the inner edge 46 of the pad 44 being aligned (FIG. 1) with the inner edges of the pads 50 and 52 and with the vertical inner edge 41 of the pad 37. When the pads are arranged as described above, a strike zone is provided. The upper edge of the strike zone is designated by the lower edge 38 of the pad 33, which edge is adjusted to a height commensurate with the shoulder height of the batter 90. The lower pad 37 is adjusted to put the upper edge 39 level with the knees of the batter 90 to form the lower edge of the strike zone. The width of the strike zone is, of course, denoted by the width of the base 14. However, the rectangular open area defined by the pads is equal in width to the strike zone, or the width of the base 14, plus the width of two conventional baseballs. For example, the numerals 57 indicate positions of two baseballs which would be just outside the strike zone, to the left of the base 14, as viewed in FIG. 2. The two balls marked 58 would show baseballs just inside of the strike zone, to the right of the base 14, as viewed in FIG. 2. The baseball 59 indicates a baseball which is shoulder high and over the plate, and in the strike zone. Any ball thrown inside a vertical imaginary line joining the inner sides of the balls 57, and a vertical imaginary line joining the inner sides of the balls 58 would be inside the strike zone. That is, assuming that they are also below the lower edge 38 of the upper pad 33 and the upper edge 39 of the lower pad 37.

It will be seen that the last described structure provides a baseball practice device for batting practice which defines individual strike zones for the batter, and allows him to decipher a definite strike as compared to a questionable strike. Any ball which would come in under the upper pad 33 and yet be opposite the lower end of the pad 40 would be a high shoulder ball. Any ball coming within the strike zone area opposite the pad 50 would be what may be termed a "chest high ball". Any ball coming just over the upper edge 39 of the lower pad 37 would be a "knee ball". A ball coming in opposite the pad 42 would be a ball between the knee and the waist. A batter 90 using the aforedescribed batting practice device will improve his eyesight, judgment and swing in using the device. It will be understood that a pitcher or pitching device would be employed to pitch the balls to a batter 90. The last described baseball practice unit can be turned at any given angle for use by a right handed or left handed batter. It will also be understood that the pads can be adjusted upwardly, downwardly and sidewardly to allow any batter, tall or short, to be aware of his strike zone. It will be further understood that the batting practice device of the present invention can be made to any desired size. For example, it can be made to a size suitable for children, and to a size suitable for big league baseball players.

The pitching practice structure of the present invention is illustrated in FIGS. 2, 3 and 4. FIG. 2 shows the addition of an L-shaped supporting pipe structure, generally indicated by the numeral 12, which is added to the batting practice structure for supporting an elongated rectangular pad 74 which has marked thereon the image of a batter designated by the numeral 91. The pad 74 is made from any suitable material, as for example, a resilient material as rubber.

The L-shaped pipe support structure 12 includes an elongated vertical pipe 60 which is integrally connected by an elbow portion 61 to a horizontal short pipe section 62. A reduced diameter rod, pipe, or the like, 63 is mounted in the free end of the horizontal pipe 62 by any suitable means, as by a press fit or by welding. The lower end of the vertical pipe 60 is provided with a C-shaped clip attachment member, generally indicated by the numeral 68. As shown in FIG. 3, the L-shaped pipe structure 12 is moved over the base plate 10 to permit the C-shaped clip attachment member 68 to be slidably mounted over the batter's end of the base plate 10. The reduced diameter rod 63 is slidably mounted into the open free end of the horizontal pipe 23, and secured thereto by any suitable means, as by a set screw 82.

The structure of the C-shaped clip attachment member 68 is illustrated in detail in FIG. 4. As shown in FIG. 4, the lower end of the vertical pipe 60 has fixedly mounted therein by any suitable means, as by a press fit or welding, a reduced diameter rod or shaft 64 which is slidably mounted within the bore 65 of a vertical mounting pipe 66. The rod 64 is secured to the pipe 66 by a suitable set screw 73. The lower end of the mounting pipe 66 is attached, as by welding, to a flange 67 which is secured by suitable screws 72 (FIG. 3) to the upper plate 71 that forms the upper part of the C-shaped clip attachment member 68. The attachment member 68 includes a lower plate 70 which is spaced apart from the plate 71 and parallel thereto. The plates 70 and 71 are integrally secured together at their outer ends by an integral, vertical bight portion or plate 69.

The upper edge 75 of the batter image pad 74 is held even with the upper edges of the pads 33 and 44 by suitable adjustable straps 76. The batter image pad 74 is secured at its lower outer corner by a suitable adjustable strap 79 to the vertical pipe 60. The lower inner corner of the batter image pad 74 is adjustably secured in position by a similar adjustable strap 79 to the vertical support pipe 31. The upper corners of the batter image pad 74 are secured to the pad 33 and pipe 60 by suitable adjustable straps 83. The lower edge 78 of the batter image pad 74 is adjusted to a position level with the lower edge of the pad 37. The numeral 80 indicates the inner vertical edge of the pad 74 which is adjusted to be slightly spaced apart from the inner edge 35 of the pad 33 and the adjacent side of the vertical support pipe 31. The outer vertical edge 81 of the batter image pad 74 is spaced apart from the vertical pipe 60.

As shown in FIG. 3, when using the baseball practice device of the present invention as a pitching practice apparatus, the strike zone area is enclosed by a pad 84 which is made from the same material as the other pads, and which is equal in width to the pad 33, and made to a height slightly less than the height of the strike zone so that it may be fitted into the strike zone. The pad 84 is suspended in position by suitable adjustable straps 85 which are connected to the lower edge of pad 33. The lower outer corner of the pad 84 is secured to the pad 37 by an adjustable strap 92. The lower inner corner is secured to the pad 74 by an adjustable strap 93.

As shown in FIG. 3, the pad 84 is divided by a vertical line and a horizontal line into four equal areas designated by the numerals 86, 87, 88 and 89. It will be seen that by numbering the last mentioned areas, a person using the device for practicing pitching can tell what type of a ball he has just pitched. For example, a ball hitting the pad area designated by the numeral 86 would be a high outside ball which may be in the strike zone, or if it hits the outer edge of the pad portion 86 it would be a high ball just outside of the strike zone. Balls hitting the area marked 87 could be either a high inside pitch or a ball which is high and inside of the strike zone area. A ball hitting the area marked 88 would be a low, outside ball in the strike zone or just outside of the strike zone. A ball hitting the area marked 89 would be a ball low and inside and in the strike zone, or just outside of the strike zone if it is on the edge of the pad area 89.

It will be seen that the image 91 of the batter shown in FIG. 3 on the pad 74 provides a person using the pitching practice apparatus with a realistic game-like situation, and enables him to visualize a replica of a batter. It will also be understood that the pad 84 could be made as a net catching a ball and secured in the strike zone area instead of a resilient pad. It will be further understood that the batting practice apparatus of the present invention could be made to a single adjusted height for an individual batter so that the pads 33, 44, 50, 52 and 37 are all made as an integral unit. On the other hand, pads 44, 50, 52 and 37 could be made as an integral L-shaped pad, with the pad 33 as a separate unit, so that pad 33 and the other integral L-shaped pad could be adjusted to provide the proper height of the strike zone for each particular batter using the batting practice device. It will further be understood that when using the baseball practice device of the present invention as a pitching device, that all of the pads shown in FIG. 3 could be formed as an integral unit for an individual batter having a predetermined height from knees to shoulders, or a predetermined strike zone.

Although the structure described hereinbefore and disclosed in FIGS. 1 and 2 was indicated to be used for batting practice, it will be understood that it may also be used for pitching practice as well, so that the structure illustrated in FIGS. 1 and 2 could be designated both as a baseball practice pitching device and a baseball practice batting device.

While it will be apparent that the preferred embodiments of the invention herein disclosed are well calculated to fulfill the objects above stated, it will be appreciated that the invention is susceptible to modification, variation and change.

What is claimed is:

1. In a baseball practice device, the combination comprising:

(a) a baseball home plate, (b) a first support means mounted adjacent said baseball home plate, (c) a pad means carried by said first support means and arranged to form a strike zone area opening over said baseball home plate, and which strike zone area opening is enclosed on three sides by the pad means, and open on one side to allow a person to throw balls into said strike zone area opening for baseball pitching practice and a batter to hit balls thrown into said strike zone area opening for batting practice, (d) a second support means mounted adjacent said baseball home plate; and, (e) a batter image pad means carried by said second support means and positioned over a batter's box area adjacent the baseball home plate.

2. A baseball practice device as defined in claim 1, including:

(a) a separate strike zone area pad means mounted in said strike zone area opening and carried by said first named pad means.

3. A baseball practice device as defined in claim 2, wherein:

(a) said first named pad means, batter image pad means, and strike zone area opening pad means are all adjustably mounted in position.

4. A baseball practice device as defined in claim 2, wherein:

(a) said strike zone area opening pad means is provided with numbering indicia thereon to divide the frontal area thereof into numbered zones.

5. In a baseball practice device, the combination comprising:

(a) a baseball home plate, (b) a first support means mounted adjacent said baseball home plate, (c) a pad means carried by said first support means and arranged to form a strike zone area opening over said baseball home plate, and which strike zone area opening is enclosed on three sides by the pad means, and open on one side to allow a person to throw balls into said strike zone area opening for baseball pitching practice and a batter to hit balls thrown into said strike zone area opening for batting practice, (d) an elongated support plate, (e) means for attaching said baseball home plate and first support means on said support plate; and, (f) said support plate having a batter's box area marked thereon adjacent said baseball home plate.

6. A baseball practice device as defined in claim 5, including:

(a) a second support means;

(b) means for detachably mounting said second support means on the support plate adjacent said baseball home plate; and, (c) a batter image pad means carried by said second support means and positioned over the batter's box area on said support plate.

7. A baseball practice device as defined in claim 6, including:

(a) a separate strike zone area pad means mounted in said strike zone area opening and carried by said first named pad means.

8. A baseball practice device as defined in claim 7, wherein:

(a) said first named pad means, batter image pad means, and strike zone area opening pad means are all adjustably mounted in position.

* * * * *